US009132306B2

(12) United States Patent
Huang et al.

(10) Patent No.: US 9,132,306 B2
(45) Date of Patent: Sep. 15, 2015

(54) METHOD FOR MECHANOCHEMICAL TREATMENT OF SOLID WASTES CONTAINING PERFLUORINATED OR POLYFLUORINATED COMPOUNDS

(75) Inventors: Jun Huang, Beijing (CN); Kunlun Zhang, Beijing (CN); Xiaoling Yang, Beijing (CN); Gang Yu, Beijing (CN); Shubo Deng, Beijing (CN); Bin Wang, Beijing (CN); Yamei Hui, Beijing (CN); Haizhu Wang, Beijing (CN)

(73) Assignee: TSINGHUA UNIVERSITY (CN)

( * ) Notice: Subject to any disclaimer, the term of this patent is extended or adjusted under 35 U.S.C. 154(b) by 0 days.

(21) Appl. No.: 14/131,689

(22) PCT Filed: Sep. 13, 2012

(86) PCT No.: PCT/CN2012/001262

§ 371 (c)(1),
(2), (4) Date: Jan. 9, 2014

(87) PCT Pub. No.: WO2014/032211

PCT Pub. Date: Mar. 6, 2014

(65) Prior Publication Data

US 2015/0174440 A1 Jun. 25, 2015

(30) Foreign Application Priority Data

Sep. 3, 2012 (CN) ..... 2012 1 0321589

(51) Int. Cl.
*A62D 3/34* (2007.01)
*A62D 101/22* (2007.01)

(52) U.S. Cl.
CPC ..... *A62D 3/34* (2013.01); *A62D 2101/22* (2013.01)

(58) Field of Classification Search
CPC ..... A62D 3/34
USPC ..... 588/316
See application file for complete search history.

(56) References Cited

U.S. PATENT DOCUMENTS 5,534,160 A 7/1996 Hong et al.

FOREIGN PATENT DOCUMENTS

| | | | |
|---|---|---|---|
| CN | 1954906 | A | 5/2007 |
| CN | 101444660 | A | 6/2009 |
| WO | 01/83127 | A1 | 11/2001 |

OTHER PUBLICATIONS

International Search Report for PCT/CN2012/001262; International Filing Date: Sep. 13, 2012; 3 pgs.

Masayuki Shintani, Yuta Naito, Shingo Yamada, et, al. "Degradation of Perfluorooctansulfonate (PFOS) and Perfluorooctanoic Acid (PFOA) by Mechanochemical Treatment" Kagaku Kogaku Ronbunshu (Journal of Chemical Engineering of Japan) 34.5 (2008): 539-544.

*Primary Examiner* — Edward Johnson

(74) *Attorney, Agent, or Firm* — Schmeiser, Olsen & Watts, LLP

(57) ABSTRACT

A method for mechanochemical treatment of solid wastes containing perfluorinated or polyfluorinated compounds is provided. It belongs to the field of environment-polluting wastes treatment, and comprises the following steps: mixing the solid waste containing perfluorinated or polyfluorinated compounds with the defluorination reagent under normal temperature and pressure conditions, putting the mixture into a planetary high-energy ball milling reactor; adopting the mechanochemical reaction to realize high-effective degradation and defluorination of perfluorinated or polyfluorinated compounds. When being adopted to degrade perfluorinated or polyfluorinated compounds, this method enjoys such advantages as simple treatment procedure, mild reaction conditions (conducted under normal temperature and pressure conditions), lower energy consumption and operating cost, complete degradation and defluorination of the target pollutants, completely inorganic and harmless end products and free of liquid or gas byproducts.

3 Claims, 5 Drawing Sheets

METHOD FOR MECHANOCHEMICAL TREATMENT OF SOLID WASTES CONTAINING PERFLUORINATED OR POLYFLUORINATED COMPOUNDS

FIELD OF TECHNOLOGY

This following relates to the treatment of environment-polluting wastes, specifically to the mechanochemical treatment of solid wastes containing perfluorinated or polyfluorinated compounds.

BACKGROUND

Perfluorinated or polyfluorinated compounds refer to a type of compounds wherein all or part of hydrogens (H) connecting to the carbons (C) are substituted by fluorine (F). The most representative perfluorinated compounds include perfluorooctane sulfonic acid and its salts (PFOS) and perfluorooctanoic acid and its salts (PFOA). They have been widely used in industrial products and consumer goods since 1950s: PFOS is an outstanding surfactant, during the past fifty years, it was extensively used as textile or leather finishing agent, foam extinguishing agent, oil drilling additive and fog inhibitor in electroplating; PFOA is an important raw material for the manufacture of high-effective fluoropolymers, which is used in the surface coating of aviation devices, electronic components and kitchen wares.

However, recent researches show that the perfluorinated or perfluorinated compounds, with PFOS and PFOA as their representatives, present such disadvantages as long-term persistence, high bioaccumulation, strong biotoxicity and capability for long-distance migration. They hardly degrade in the natural environment. Since 1990s, PFOS and PFOA have been frequently detected out in surface water, ground water, sediments, bodies of both animals and human beings. These facts have caused great concerns throughout the world and many actions have been taken to deal with the PFOS- and PFOA-related pollution. In 2006, the European Union issued *Restrictions on the Marketing and Use of Perfluorooctane Sulfonate*. In the same year, the United States Environmental Protection Agency (EPA) also launched a self-initiated plan requiring the related enterprises to reduce 95% of PFOA discharge by 2010 and to realize zero discharge of PFOA by 2015. In May of 2009, the Fourth Session of the Conference of Parties listed PFOS in Annex A of *Stockholm Convention on Persistent Organic Pollutants* (POPs Treaty).

With PFOS being listed in the POPs Treaty and banned internationally, some other perfluorinated or polyfluorinated compounds appeared on the market as substitutes to PFOS and PFOA. These compounds include perfluorinated ones such as perfluorobutane sulfonic acid and its salts (PFBS) (typical CAS numbers: 375-73-5, 29420-49-3), perfluorohexane sulfonic acid and its salts (PFHxS), (typical CAS numbers: 355-46-4, 3871-99-6) and perfluoroalkyl ether potassium sulfonate (trade name: F-53B) (typical CAS number: 73606-19-6), and polyfluorinated ones such as 6:2 fluorotelomer sulfonic acid and its salts (6:2 FTS) (typical CAS numbers: 27619-97-2, 425670-75-3). Except presenting lower bioaccumulation, these new compounds do not show significant improvements in respect of degradation or persistence in comparison with PFOA and PFOS.

In view of this situation, finding appropriate methods to treat solid wastes containing perfluorinated or polyfluorinated compounds are of great practical importance. Currently, the commonest way to degrade solid wastes containing perfluorinated compounds is high-temperature incineration, which not only requires strict reaction conditions and reaction equipments, but also is likely to produce hydrogen fluoride, an acidic corrosive gas, and even the byproduct dioxin. Therefore, it is very urgent to develop non-incineration technologies for treating solid wastes containing perfluorinated or polyfluorinated compounds.

The mechanochemical method is to degrade the pollutant by mixing the solid pollutant and the reaction reagent together into a high-energy ball milling reactor and starting chemical reaction between them by means of mechanic force. Most of existing documents, including patents and articles, on the mechanochemical method involves the treatment of chlorinated persistent organic pollutants, and currently there is only one document [Masayuki Shintani, Yuta Naito, Shingo Yamada, et, al. "Degradation of Perfluorooctansulfonate (PFOS) and Perfluorooctanoic Acid (PFOA) by Mechanochemical Treatment" *Kagaku Kogaku Ronbunshu* (*Journal of Chemical Engineering of Japan*) 34.5 (2008): 539-544.] disclosed a mechanochemical method for treating fluorinated persistent organic pollutants (such as PFOS or PFOA), the carbon-fluorine bond of which contains higher bond energy. In this essay, the common calcium oxide was mixed with PFOS and PFOA separately, then the mixture was put into a planetary ball mill and milled at the rotation rate of 700 rpm; after 3 hours (for PFOS) and 18 hours (for PFOA) of reaction, both PFOS and PFOA are almost completely decomposed. However, the detected amount of inorganic fluorine is negligible (lower than 1% of theoretical yield), and in the case of PFOS, the highest amount of detected sulfate ion is lower than 50% of theoretical yield. The result of this disclosed document suggests that on the one hand, the mechanochemical method is technically feasible for treatment of PFOS and PFOA, and on the other, the adoption of calcium oxide as the reaction reagent presents considerable limitations.

In practical process of wastes treatment, we not only expect transformation of the target material, but also hope that the fluorine therein can effectively turn inorganic, which is an extremely important sign of defluorination and detoxication of PFOS and PFOA. That is to say, the existing method should be further improved. In addition, in view of the fact that most of perfluorinated or polyfluorinated substitutes still present high indegradability and strong persistence, it is necessary to find out suitable treatment methods for high-effectively degrading these new compounds.

SUMMARY

An aspect relates to a method for mechanochemical treatment of solid wastes containing perfluorinated or polyfluorinated compounds.

A method for mechanochemical treatment of solid wastes containing perfluorinated or polyfluorinated compounds, comprising the following steps: mixing the solid waste containing perfluorinated or polyfluorinated compounds with the defluorination reagent under normal temperature and pressure conditions; putting the mixture into the dry ball milling pot of a planetary high-energy ball milling reactor, adding the milling balls into the ball milling pot and sealing it tight; securing the loaded ball milling pot on the ball mill and starting the milling process at the revolution rate of 200-400 rpm; changing the direction of revolution every 30 minutes till the perfluorinated or polyfluorinated compounds are completely degraded and defluorinated through the mechanochemical reaction; the said defluorination reagent is solid potassium hydroxide (KOH) and the mass ratio between the defluorination reagent and the perfluorinated or polyfluorinated compounds is 5-95:1.

The perfluorinated compounds include perfluorooctane sulfonic acid and its salts, perfluorooctanoic acid and its salts, perfluorobutane sulfonic acid and its salts, perfluorohexane sulfonic acid and its salts, and perfluoroalkyl ether potassium sulfonate.

The polyfluorinated compounds include 6:2 fluorotelomer sulfonic acid and its salts.

In comparison with the prior art, the present invention has following beneficial effects: 1) KOH is adopted as the defluorination reagent during the ball milling process, which realizes not only complete degradation of perfluorinated or polyfluorinated compounds, but also 90% recovery rate of fluoride ions. The high defluorination efficiency means that a solid defluorination reaction in real sense has been realized. In contrast, in the above mentioned reference document, calcium oxide was adopted as the defluorination reagent in the ball milling process. Though such a choice assures smooth degradation of the perfluorinated compounds, the recovery rate of fluoride ions was almost zero, which means the defluorination reaction was not obtained in effect. 2) after being treated with the mechanochemical method disclosed in the present invention, the organic fluorine and sulfonic acid are transformed into inorganic fluoride ions and sulfate ions, which means that the perfluorinated or polyfluorinated compounds with POPs properties are effectively degraded into nontoxic, inorganic fluorides. 3) the mechanochemical reaction is a type of solid reactions. It does not require any organic solvents or hydrogen-donating reagents in liquid form; neither does it produce any harmful end products (including gas or liquid). 4) the technical procedure and reaction conditions of the method disclosed in the present invention is easy to be realized. The revolution rate of the ball mill is kept at medium speed (275 rpm), namely 60% lower than the speed disclosed in the said reference document (700 rpm), which consequently greatly reduces energy consumption and strength requirements on equipments. 5) the energy consumption and operating cost is much lower than that of the traditional high-temperature incineration.

BRIEF DESCRIPTION

DETAILED DESCRIPTION

The following provides a method for mechanochemical treatment of solid wastes containing perfluorinated or polyfluorinated compounds. This method can degrade the perfluorinated or polyfluorinated compounds into harmless inorganic fluoride salts. As the perfluorinated or polyfluorinated compounds are detoxicated and completely transformed into inorganic substances, their threat to the natural environment and the health of living organisms is prevented. In the following paragraphs, the present invention is more specifically described by way of example with reference to the attached drawings.

EXAMPLE 1

Figure 1:
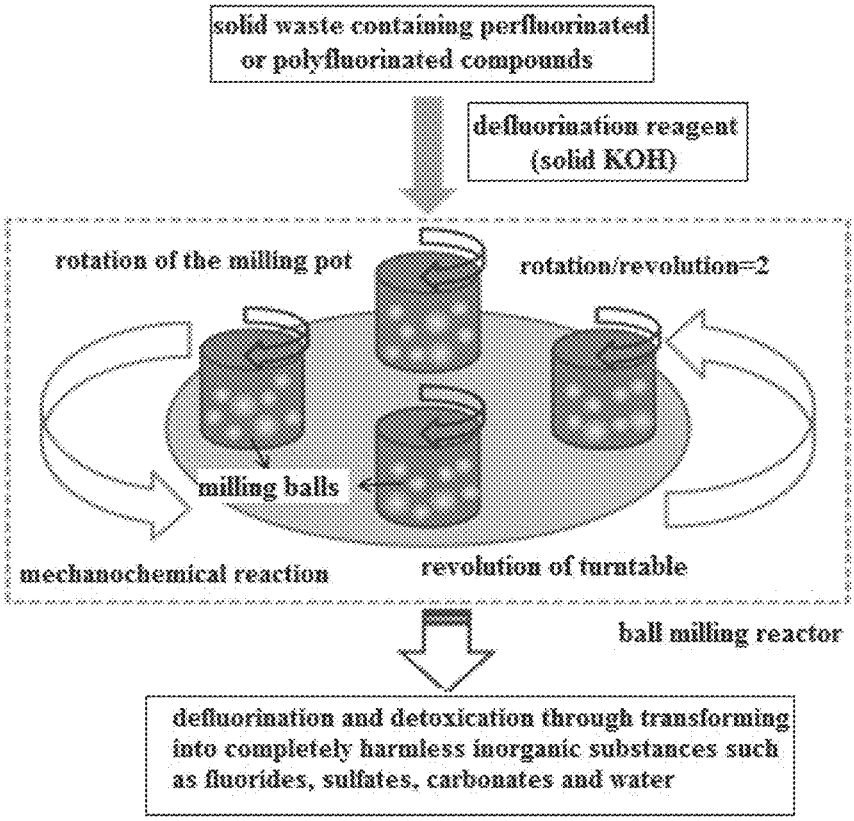
FIG. 1 shows the processing steps of the mechanochemical treatment of solid wastes containing perfluorinated or polyfluorinated compounds.

In order to compare the performance of solid KOH with other defluorination reagents, the same mass of CaO, mixture of iron and silica sand (Fe—SiO2, mass ratio of Fe and SiO2 is 10:1), sodium hydroxide (NaOH) and solid KOH are used as defluorination reagents and are put through the processing steps shown in FIG. 1.

Figure 2:
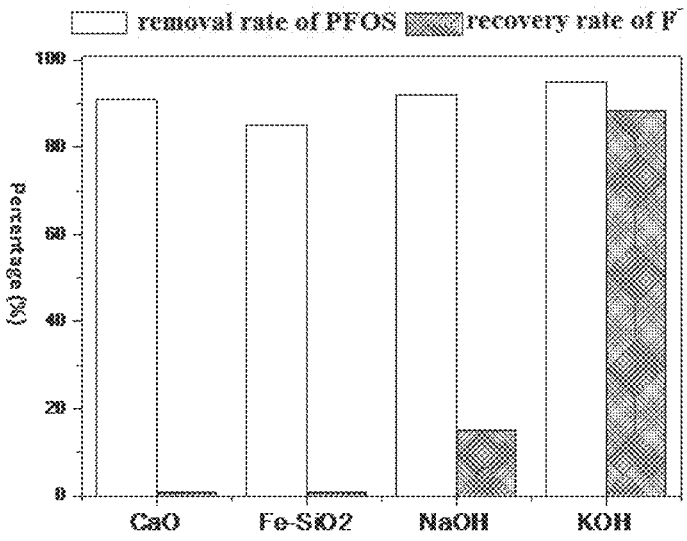
FIG. 2 shows the effect of mechanochemical degradation of PFOS when different defluorination reagents are adopted (after 4 hours of milling).

Separately mixing different defluorination reagents with the solid waste containing 85% potassium perfluorooctane sulfonate (PFOS) together at the mass ratio of 23:1 (namely 4.6 g defluorination reagent and 0.2 g PFOS waste) and putting 4.8 g of different mixtures so obtained into ball milling pots, adding 20 big milling balls (9.60 mm in diameter and weight 4.15 g in average) and 90 small milling balls (5.50 mm in diameter and weight 0.88 g in average) into each pot. All the ball milling pots are 45 mm in depth, 50 mm inner diameter and with 85 mL of effective volume; there is an elastic gasket between the pot opening and the lid for tight sealing. Securing the loaded ball milling pots on the planetary ball mill, setting the revolution rate of the mill at 275 rpm and changing the direction of revolution every 30 minutes. Milling the samples containing different defluorination reagents for 4 hours, collecting the powder from the ball milling pots into a sealed bag. During the laboratory analysis, dissolving 0.050 g powder containing different defluorination reagents in 50 mL high-purity water separately and using ultrasonic vibration 30 minutes to ensure complete dissolution. Analyzing the solutions so obtained with the liquid chromatography—mass spectrometry—mass spectrometry (LC-MS-MS) to determine the residual amount of PFOS and with ion chromatography (IC) to determine the concentration of fluoride ions. As is shown in FIG. 2, when solid KOH is adopted as the defluorination reagent, it can ensure not only high degradation rate of PFOS but also transformation of most organic fluorine into inorganic ions; in contrast, when other defluorination reagents are adopted, though their performance in degrading PFOS is also good, they cannot ensure transformation of most organic fluorine into inorganic ions due to the low recovery rate of fluoride ions. Therefore, in comparison with other defluorination reagents, KOH is more desirable, more suitable for practical application.

EXAMPLE2

Figure 3:
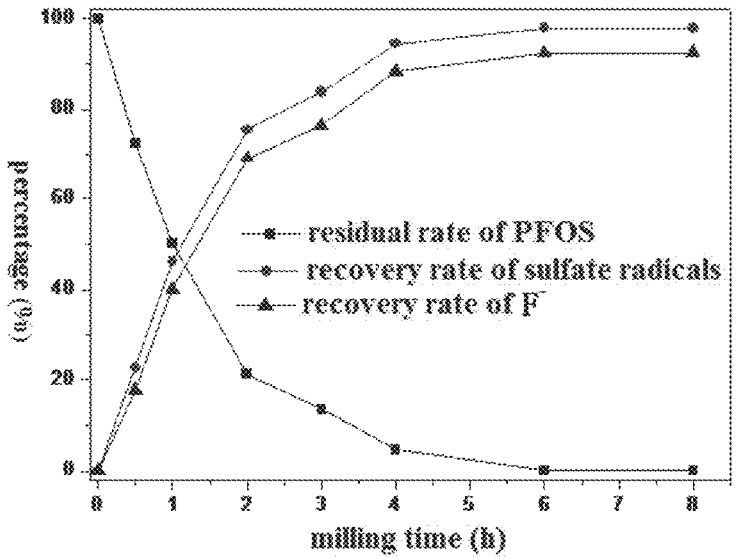
FIG. 3 shows the effect of solid KOH (as defluorination reagent) in mechanochemical degradation of PFOS in relation to different milling time.

Adopting solid KOH as the defluorination reagent and keeping the reaction conditions the same as in example 1, this example is designed to determine the influence of different milling time upon the effect of ball milling process. Milling the different batches of the same sample for 0.5 h, 1 h, 2 h, 3 h, 4 h, 6 h, 8 h respectively, collecting the powder from the ball milling pots into a sealed bag. During the laboratory analysis, dissolving 0.050 g powder obtained after different milling time in 50 mL high-purity water separately and using ultrasonic vibration 30 minutes to ensure complete dissolution. Analyzing the solutions so obtained with the liquid chromatography—mass spectrometry—mass spectrometry (LC-MS-MS) to determine the residual amount of PFOS and with ion chromatography (IC) to determine the concentration of fluoride ions and sulfate ions. As is shown in FIG. 3, PFOS is gradually degraded with the increase of the milling time while the recovery rates of fluoride ions and sulfate ions increase correspondingly. Under the same experimental conditions, the degradation rate of PFOS reaches 99.9% after 6 hours of ball milling time; meanwhile the recovery rates of fluoride ions and sulfate ions reach 92.3% and 97.6% respectively. The experiment results show that the PFOS has been completely degraded; the organic fluorine and sulfonate groups have been successfully transformed into inorganic fluorides and sulfates. Therefore, both degradation and defluorination of PFOS are satisfactorily realized.

EXAMPLE 3

Figure 4:
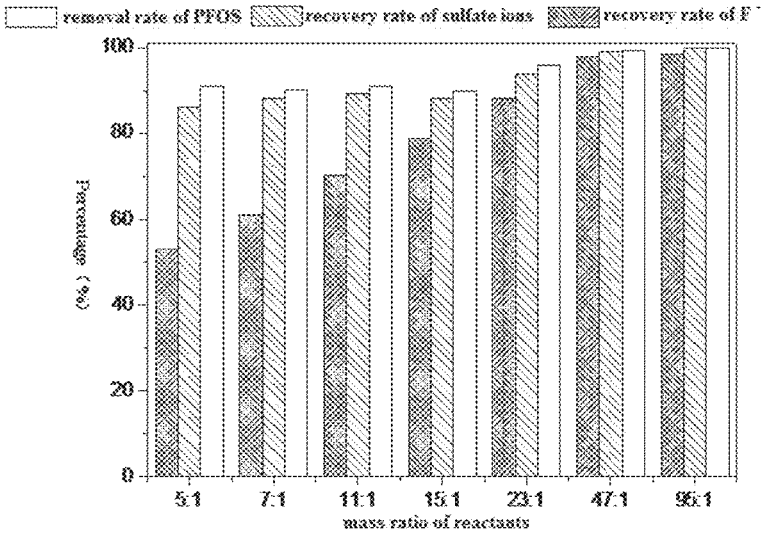
FIG. 4 shows the effect of solid KOH (as defluorination reagent) in mechanochemical degradation of PFOS at the different mass ratios of reactants.
Figure 5:
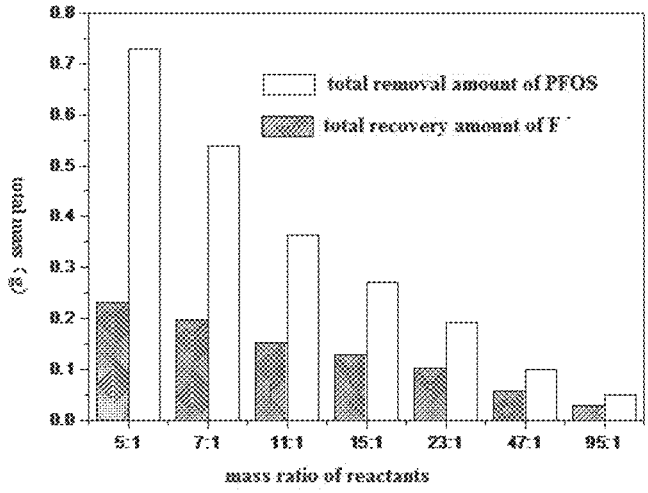
FIG. 5 shows the absolute removal amount of PFOS at the different mass ratios of reactants when solid KOH is adopted as the defluorination reagent.

Adopting different mass ratios of reactants (KOH: PFOS=5:1, 7:1, 11:1, 15:1, 23:1, 47:1 and 95:1 respectively) and keeping the total mass of reactants 4.8 g, adding the mixtures of different mass ratios into ball milling pots and conducting the milling experiment under the same conditions as in example 1. As is shown in FIG. 4, after 4 hours of milling process, the degradation rate of PFOS and the recovery rate of sulfate ions keep stable firstly and then increase in accordance with the increase of the mass ratios of reactants; the recovery rate of fluoride ions shows linear increase in relation to the increase of the mass ratios of reactants. The higher the mass ratios, the faster the degradation rate and the better the degradation effect; however, the consumption of KOH increases accordingly. The better degradation effect, while keeping the mass ratio of the reactants unchanged, can also be realized through extending milling time. In addition, though the high mass ratio of the reactants ensures the high rate of degradation and defluorination, the total amounts of PFOS removal and defluorination are comparatively small; in contrast, though the low mass ratio of the reactants sees lower efficiency in degradation and defluorination, the total amounts of PFOS removal and defluorination are comparatively large. The total amounts of PFOS removal and defluorination under different mass ratios of the reactants are shown in FIG. 5. In practical application, the optimal treatment effect can be obtained through adjusting the balance between changing the mass ratio of the reactants and controlling the milling time.

EXAMPLE 4

Figure 6:
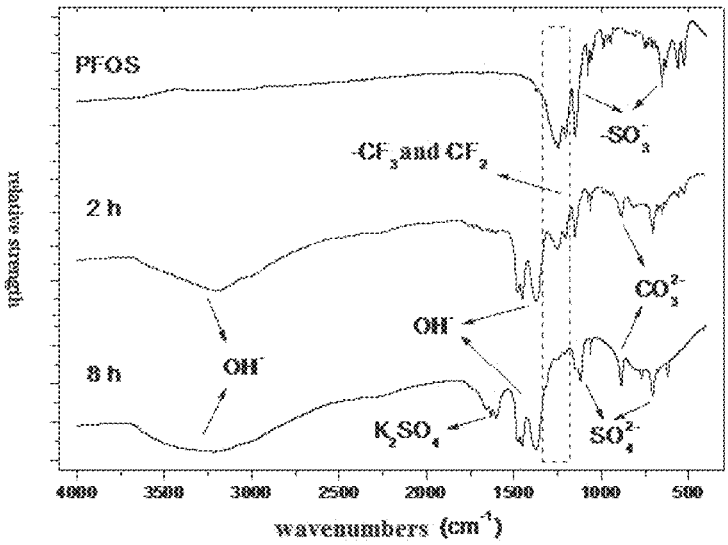
FIG. 6 is the FTIR image of the mechanochemical degradation of PFOS when solid KOH is adopted as the defluorination reagent.
Figure 7:
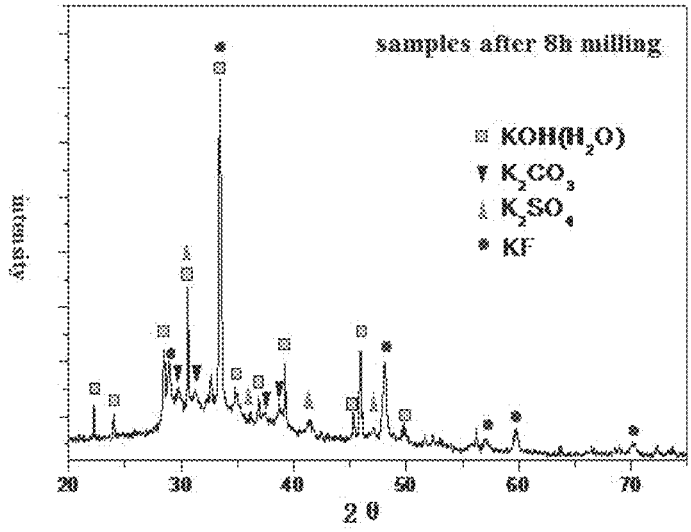
FIG. 7 is the XRD image of the mechanochemical degradation of PFOS when solid KOH is adopted as the defluorination reagent.

In order to show the mechanochemical reaction of perfluorinated or polyfluorinated compounds and its end products more clearly, the Fourier transform infrared spectroscopy (FTIR) and X-ray diffractometry (XRD) are adopted in this example to characterize the samples obtained after the milling process. Raising the concentration of PFOS and keeping the mass ratio of the reactants at 5:1 (namely 4.0 g KOH and 0.8 g PFOS) so that the change of PFOS and the end products can be more clearly shown in the images. The FTIR image of PFOS after different milling time is shown in FIG. 6. In the image, the peaks appeared at 1200-1300 $cm^{-1}$ result from the vibration of —CF3 and —CF2; with the progression of ball milling process, the peaks caused by —CF3 and —CF2 in PFOS decrease gradually and almost disappear after 8 hours of milling. This indicates that the mechanochemical reaction occurred during the milling process has destroyed the C—F bonds in PFOS and transformed the fluorine broken away from PFOS into inorganic fluoride ions. In the case of inorganic sulfate ions and carbonate ions transformed from the sulfonic ions and carbon in PFOS, their FTIR imaging results are in consistence with those obtained in the former experiment. The XRD image of PFOS after 8 hours of milling process is shown in FIG. 7. As is indicated in the XRD image, after 8 hours of mill process, there is a large amount of residual defluorination reagent in the sample; the concentration of potassium fluoride (KF) in the newly-formed material is fairly high while that of potassium sulfate and potassium carbonate is comparatively low. In conclusion, the XRD results are in consistence with those tested out through FTIR and IC techniques.

EXAMPLE 5

Figure 8:
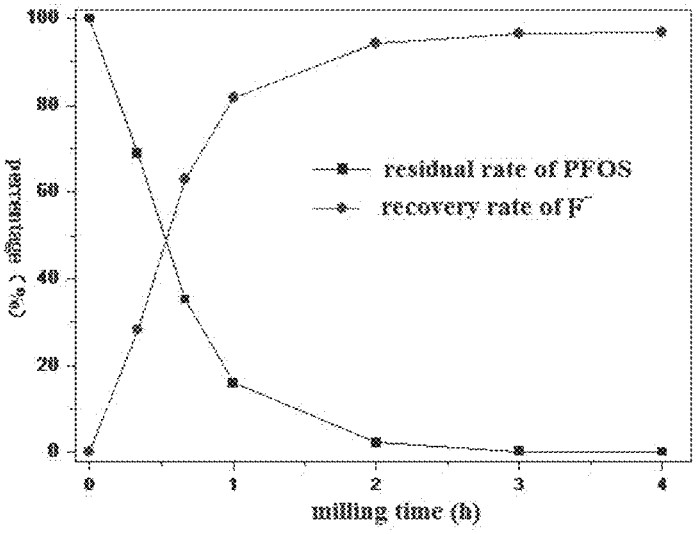
FIG. 8 shows the effect of solid KOH (as defluorination reagent) in mechanochemical degradation of PFOA in relation to different milling time.

Mixing the defluorination reagent solid KOH with the solid waste containing 95% of sodium perfluorooctanoate (PFOA) together at the mass ratio of 23:1 (namely 4.6 g solid KOH and 0.2 g PFOA waste) and putting 4.8 g mixture into ball milling pots, adding 20 big milling balls (9.60 mm in diameter and weight 4.15 g in average) and 90 small milling balls (5.50 mm in diameter and weight 0.88 g in average) into each pot. All the ball milling pots are 45 mm in depth, 50 mm inner diameter and with 85 mL of effective volume; there is an elastic gasket between the pot opening and the lid for tight sealing. Securing the loaded ball milling pots on the planetary ball mill, setting the revolution rate of the mill at 275 rpm and changing the direction of revolution every 30 minutes. Milling the different batches of the same sample for 20 min, 40 min, 1 h, 2 h, 3 h and 4 h respectively, collecting the powder from the ball milling pots into a sealed bag. During the laboratory analysis, dissolving 0.050 g powder obtained after different milling time in 50 mL high-purity water separately and using ultrasonic vibration 30 minutes to ensure complete dissolution. Analyzing the solutions so obtained with the liquid chromatography—mass spectrometry—mass spectrometry (LC-MS-MS) to determine the residual amount of PFOS and with ion chromatography (IC) to determine the concentration of fluoride ions. As is shown in FIG. 8, PFOA is gradually degraded with the progression of ball milling time and the recovery rate of fluoride ions increases accordingly; after 3 hours of milling time, the degradation rate of PFOA reaches 99.99% and the recovery rate of fluoride ions reaches 96.6%. That is to say, under such experiment conditions, PFOA is completely degraded and all organic fluorine is transformed into inorganic fluorides. Therefore, both degradation and defluorination of PFOA are satisfactorily realized. The experiment results also indicate that, under the same conditions, the degradation rate of PFOA is much faster than that of PFOS, which is in consistence with the findings disclosed in the reference document.

EXAMPLE 6

Figure 9:
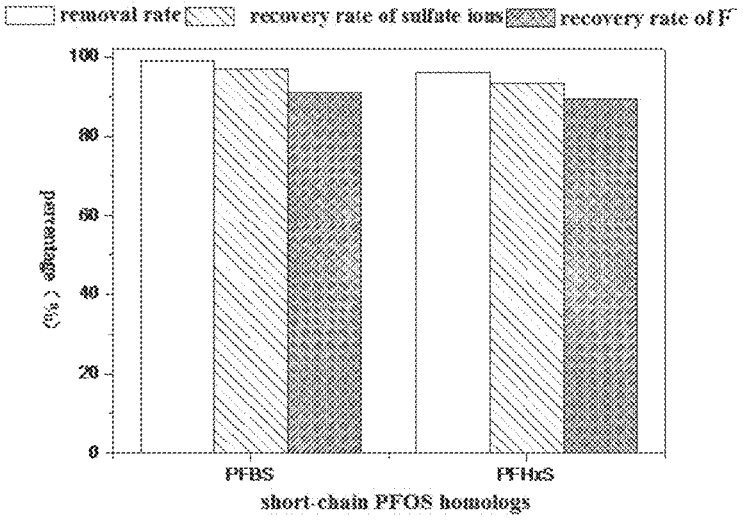
FIG. 9 shows the effect of solid KOH (as defluorination reagent) in mechanochemical degradation of PFBS and PFHxS.

Mixing the defluorination reagent solid KOH with the solid waste containing 92% of PFBS and 96% of PFHxS respectively at the mass ratio of 23:1 (namely 4.6 g KOH and 0.2 g PFBS or PFHxS waste) and putting 4.8 g mixture so obtained into ball milling pots, adding 20 big milling balls (9.60 mm in diameter and weight 4.15 g in average) and 90 small milling balls (5.50 mm in diameter and weight 0.88 g in average) into each pot. All the ball milling pots are 45 mm in depth, 50 mm inner diameter and with 85 mL of effective volume; there is an elastic gasket between the pot opening and the lid for tight sealing. Securing the loaded ball milling pots on the planetary ball mill, setting the revolution rate of the mill at 275 rpm and changing the direction of revolution every 30 minutes. Milling the samples containing different solid wastes for 4 hours, collecting the powder from the ball milling pots into a sealed bag. During the laboratory analysis, dissolving 0.050 g powder obtained after the milling process in 50 mL high-purity water separately and using ultrasonic vibration 30 minutes to ensure complete dissolution. Analyzing the solutions so obtained with the liquid chromatography—mass spectrometry—mass spectrometry (LC-MS-MS) to determine the residual amounts of the target materials and with ion chromatography (IC) to determine the concentration of fluoride ions and sulfate ions. As is shown in FIG. 9, in the case of the solid waste containing PFBS, the degradation rate of PFBS is higher than 99% after 4 hours of milling process, and the recovery rates of sulfate ions and fluoride ions are 96.8% and 91.2% respectively; in the case of the solid waste containing PFHxS, the degradation rate of PFHxS is higher than 96% after 4 hours of milling process, and the recovery rates of sulfate ions and fluoride ions are 93.6% and 89.3% respectively. The results indicate that, under the same experimental conditions, these two short-chain homologs of PFOS can be effectively degraded, and the organic fluorine therein is transformed into inorganic fluoride ions, which means that the degradation and defluorination processes can be satisfactorily realized simultaneously.

EXAMPLE 7

Figure 10:
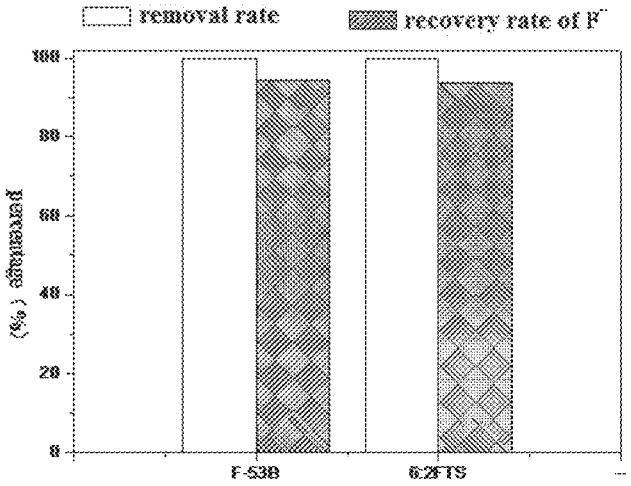
FIG. 10 shows the effect of solid KOH (as defluorination reagent) in mechanochemical degradation of F-53B and 6:2FTS.

Mixing the defluorination reagent solid KOH with the solid waste containing 98% of F-53B and 95% of 6:2 FTS respectively at the mass ratio of 23:1 (namely 4.6 g KOH and 0.2 g F-53B or 6:2 FTS waste) and putting 4.8 g mixture so obtained into ball milling pots, adding 20 big milling balls (9.60 mm in diameter and weight 4.15 g in average) and 90 small milling balls (5.50 mm in diameter and weight 0.88 g in average) into each pot. All the ball milling pots are 45 mm in depth, 50 mm inner diameter and with 85 mL of effective volume; there is an elastic gasket between the pot opening and the lid for tight sealing. Securing the loaded ball milling pots on the planetary ball mill, setting the revolution rate of the mill at 275 rpm and changing the direction of revolution every 30 minutes. Milling the samples containing different solid wastes for 4 hours, and collecting the powder from the ball milling pots into a sealed bag. During the laboratory analysis, dissolving 0.050 g powder obtained after the milling process in 50 mL high-purity water separately and using ultrasonic vibration 30 minutes to ensure complete dissolution. Analyzing the solutions so obtained with the liquid chromatography-mass spectrometry-mass spectrometry (LC-MS-MS) to determine the residual amounts of the target materials and with ion chromatography (IC) to determine the concentration of fluoride ions. As is shown in FIG. 10, in the case of the solid waste containing F-53B, the degradation rate of PFBS reaches 100% after 4 hours of milling process, and the recovery rate of fluoride ions reaches 94.5%; in the case of the solid waste containing 6:2 FTS, the degradation rate of 6:2 FTS also reaches 100% after 4 hours of milling process, and the recovery rate of fluoride ions reaches 93.6%. The results indicate that, under the same experimental conditions, these two perfluorinated or polyfluorinated compounds can be effectively degraded and the organic fluorine therein is transformed into inorganic fluoride ions, which means that the degradation and defluorination processes can be satisfactorily realized simultaneously.

What is claimed is:

1. A method for mechanochemical treatment of solid wastes containing perfluorinated or polyfluorinated compounds, comprising the following steps:

mixing the solid wastes containing perfluorinated or polyfluorinated compounds with a defluorination reagent under a normal temperature and a pressure condition to form a mixture;

putting the mixture into a dry ball milling pot of a planetary high-energy ball milling reactor, adding a plurality of milling balls into the dry ball milling pot and sealing the dry ball milling pot tight;

securing the dry ball milling pot on a ball mill and starting a milling process at a revolution rate of 200-400 rpm;

changing a direction of the revolution every 30 minutes until the perfluorinated or polyfluorinated compounds are completely degraded and defluorinated through a mechanochemical reaction;

wherein the defluorination reagent is solid potassium hydroxide (KOH) and a mass ratio between the defluorination reagent and the perfluorinated or polyfluorinated compounds is 5-95:1.

2. The method for mechanochemical treatment of solid wastes containing perfluorinated or polyfluorinated compounds of claim 1, wherein the perfluorinated compounds include perfluorooctane sulfonic acid and its salts, perfluorooctanoic acid and its salts, perfluorobutane sulfonic acid and its salts, perfluorohexane sulfonic acid and its salts and perfluoroalkyl ether potassium sulfonate.

3. The method for mechanochemical treatment of solid wastes containing perfluorinated or polyfluorinated compounds of claim 1, wherein the polyfluorinated compounds include 6:2 fluorotelomer sulfonic acid and its salts.

* * * * *